US006467344B1

(12) United States Patent
Ly et al.

(10) Patent No.: US 6,467,344 B1
(45) Date of Patent: Oct. 22, 2002

(54) UNDERGROUND STORAGE TANK BUOYANCY AND BUOYANCY SAFETY FACTOR CALCULATION METHOD AND APPARATUS

(75) Inventors: Kiet T. Ly, Richfield; John Burwell, Eagan; Albert F. Dorris, Edina, all of MN (US); Robin Berg, Hudson, WI (US)

(73) Assignee: Xerxes Corporation, Minneapolis, MN (US)

( * ) Notice: Subject to any disclaimer, the term of this patent is extended or adjusted under 35 U.S.C. 154(b) by 86 days.

(21) Appl. No.: 09/657,807

(22) Filed: Sep. 8, 2000

(51) Int. Cl.[7] ..... G01M 1/00
(52) U.S. Cl. ..... 73/432.1
(58) Field of Search ..... 73/432.1; 702/33, 702/41, 127

*Primary Examiner*—Robert Raevis
(74) *Attorney, Agent, or Firm*—Piper Marbury; Rudnick & Wolfe, LLP; Steven B. Kelber

(57) ABSTRACT

A method for calculating underground storage tank (UST) buoyancy and buoyancy safety factors defines boundaries of side areas such that the boundaries do not overlap for multiple tank installations. Installation plan information may be input over a medium such as the Internet. The computer calculates the buoyancy and buoyancy safety factor and returns this information to the requesting party over the same medium. This technique allows installers to verify the adequacy of installation plans quickly. Records of the information provided by the installer may be kept so the recipient of the information (typically the UST manufacturer) can reconcile differences between the actual installation and the installation plan in the event of UST flotation. The information may be provided on a paper form supplied by the installer. In preferred embodiments, the calculations are tailored to installation guidelines (often provided by the UST manufacturer), which may specify such parameters as spacing between tanks in multi-tank installations, some or all deadman dimensions, slab dimensions, etc. Preferred embodiments generate a form letter that includes the installation plan information and the results of the buoyancy and/or buoyancy safety factor calculations.

15 Claims, 17 Drawing Sheets

$$\Sigma W_{UPWARD} = W_S + W_T$$

$$\Sigma W_{DOWNWARD} = (W_{T.S.} + 2W_D + W_{S.O.T.} + 2W_{S.C.} + 2W_{E.W.} + W_t)$$

$$\text{SAFETY FACTOR} = \frac{\Sigma W_{DOWNWARD}}{\Sigma W_{UPWARD}} \geq 1.20$$

TYPICAL INSTALLATION PLAN VIEW

TYPICAL DEADMEN INSTALLATION PLAN VIEW

TYPICAL DEADMEN INSTALLATION PLAN VIEW

DATE

Mr. John Doe
Portico
FAX (415) 555-1212

Re: 8'-12,000 Gallon, 8'-8,000 Gallon, and 8'-6,000 Gallon DW Tanks
Gas N' Go
Washington, DC 2000

Dear Mr. Doe:

We have summarized the buoyancy data for your installation at the above-mentioned site. All of the calculations are based on the site data and standard engineering values for the physical parameters, which you provided for the site.

All of the calculations have been made in accordance with the protocols presented in the PEI manual RP-100/97. These protocols present an analysis of underground tank buoyancy, which is based on sound engineering practice.

It is the tank owner's responsibility to determine the suitability and applicability of installation. Our sole responsibility in any installation is that which is presented in our standard warranty.

Given the installation parameters that you have provided us, our calculations show that the 8'-12,000 gallon, 8'-8,000 gallon, and 8'-6,000 gallon double wall tanks have a Buoyancy Safety Factor of 1.43:1, 1.50:1, and 1.57:1, respectively. Xerxes recommends a minimum of 1.20:1 Safety factor.

I have included copies of the worksheets for your files.

If I can be of additional assistance, please feel free to contact me.

Very truly yours,

Kiet T. Ly
Technical Support Engineer

/kl

Enclosure

FIG.8

TYPICAL 8' DIAM. TANK
NON-ANCHORING SYSTEM

TYPICAL 8' DIAM. TANK
NON-ANCHORING SYSTEM
PEI APPROACH

TYPICAL 8' – 8K DW TANK
NON-ANCHORING SYSTEM
PEI APPROACH

TYPICAL 8' DIAM. TANK
BOTTOM SLAB ANCHORING SYSTEM

TYPICAL 8' DIAM. TANK
DEADMAN ANCHORING SYSTEM

TYPICAL 8' DIAM. TANK
BOTTOM SLAB ANCHORING SYSTEM

TYPICAL 8' DIAM. TANK
DEADMEN ANCHORING SYSTEM

TYPICAL 8' DIAM. TANK
OPTIONAL APPROACH

1800

XERXES CORPORATION
BUOYANCY CALCULATION REQUEST

DATE: _____

CUSTOMER: _____ CONTACT: _____
(TANK OWNER) _____ PHONE ( ) _____
PROJECT NAME: _____ FAX ( ) _____
TANK LOCATION _____
CONTRACTOR: _____ CONTACT _____
_____ PHONE ( ) _____
_____ FAX ( ) _____

1810

1820

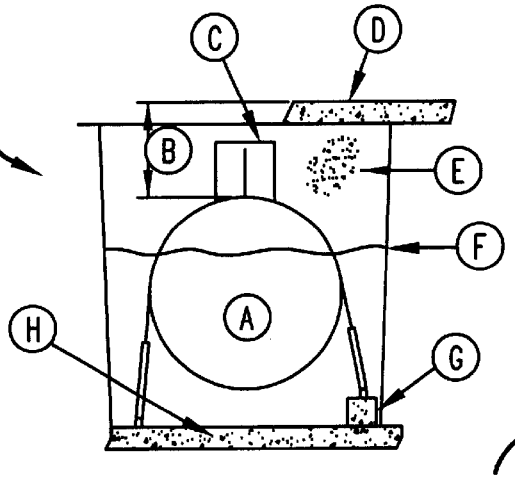

1830

A. TANK SIZE: _____ GALS. _____ DIA. SW DWT-II DWT-I BRINE _____

B. BURIAL DEPTH (TOP OF TANK TO GRADE) _____ INCLUDING TOP SLAB (WHEN APPROPRIATE)

C. # OF ATTACHED COLLAR RISERS (ARC) _____ DIAM. 42" / 48" (circle one)

D. TOP SLAB THICKNESS _____ CONCRETE OR ASPHALT (circle one)

E. BACKFILL TYPE _____ BALLAST AMOUNT _____ (GAL) BALLAST TYPE _____

F. WATER TABLE (circle one) MID-TANK TANK TOP AT GRADE

G. DEADMEN _____ LENGTH _____ ft; WIDTH _____ in; THICKNESS _____ in.

or

H. FULL BOTTOM SLAB _____ TANK SPACING _____ IN; SIZE _____ ft. by _____ ft; THICKNESS _____ in.

COMMENT: _____

FIG.18

1900

XERXES CORPORATION
BUOYANCY CALCULATION REQUEST

DATE: 9/10/'99

CUSTOMER: SPEEDWAY SUPERAMERICA
(TANK OWNER)
PROJECT NAME: SUPERAMERICA # 1234
TANK LOCATION 120 WEST BROADWAY, GRAND RAPIDS, MI
CONTRACTOR: J.J PUMP & TANK, INC
GRAND RAPIDS, MI

CONTACT: JOHN JOHNSON
PHONE ( ) 888-8888
FAX ( ) 888-8889

CONTACT LEO SMITH
PHONE ( ) 886-1245
FAX ( ) 886-1246

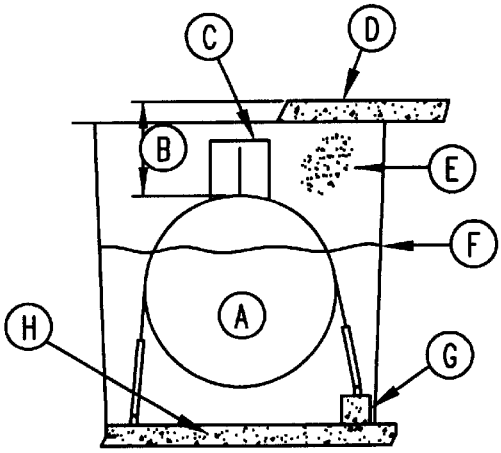

A. TANK SIZE: 15K GALS. 10' DIA. SW (DWT-II) DWT-I BRINE _____

B. BURIAL DEPTH (TOP OF TANK TO GRADE) 3' INCLUDING TOP SLAB (WHEN APPROPRIATE)

C. # OF ATTACHED COLLAR RISERS (ARC) 1 DIAM. (42") / 48" (circle one)

D. TOP SLAB THICKNESS 6" (CONCRETE) OR ASPHALT (circle one)

E. BACKFILL TYPE PEA GRAVEL BALLAST AMOUNT NONE (GAL) BALLAST TYPE _____

F. WATER TABLE (circle one) MID-TANK TANK TOP (AT GRADE)

G. DEADMEN _____ LENGTH _____ ft; WIDTH _____ in; THICKNESS _____ in.

or

H. FULL BOTTOM SLAB ✓ TANK SPACING 18" IN; SIZE 10 ft. by O.A.L. ft; THICKNESS 8" in.

COMMENT: O.A.L. IS AN ACRONYM FOR OVERALL LENGTH OF THE TANK.

FIG.19

UNDERGROUND STORAGE TANK BUOYANCY AND BUOYANCY SAFETY FACTOR CALCULATION METHOD AND APPARATUS

BACKGROUND OF THE INVENTION

1. Field of the Invention

The invention relates to underground storage tanks generally, and more particularly to a method and apparatus for calculating underground storage tank buoyancy and buoyancy safety factors for various installations.

2. Discussion of the Background

Underground storage tanks (USTs) are commonly used for the underground storage of a wide variety of liquids, including the underground storage of fuels at locations such as gas stations. USTs are installed in a wide variety of locations and under a wide variety of conditions. In some locations, the water table is high enough such that some or all of the UST is below the water table. In these situations, a buoyant upward force will act on the tank. If the buoyant force exceeds the downward forces acting on the tank, the tank will 'float' up out of the ground. This situation is obviously undesirable. Accordingly, it is necessary to determine the buoyant and downward forces acting on the tank to prevent this situation. Furthermore, some local governments require an installation to have a minimum buoyancy safety factor. The buoyancy safety factor is defined as the ratio of downward forces to upward forces. Thus, if a local government requires a safety factor of 1.2, then the installation requires downward forces acting on the tank to be 1.2 times greater than the buoyancy forces.

One source of downward force that acts on an installed UST is the backfill directly over the UST. As the burial depth increases, more backfill is placed over the tank and therefore more downward force acts on the tank. However, in some locations, it is impossible, impractical or prohibitively expensive to install a tank at a depth sufficient to compensate for buoyancy forces acting on the tank. Several schemes for increasing the downward force acting on the tank without increasing the burial depth are known in the art. One method is to form a concrete slab over the tank. A second method is to form a concrete slab below the tank and anchor the tank to the slab using straps or the like. A third method is to bury deadmen along with the tank and anchor the tank to the deadmen. An installation plan may employ one or more of these methods.

Ensuring that an installation plan for a single UST or multiple USTs is adequate is naturally of concern to UST installers. However, most tank installers do not have the knowledge and expertise to calculate the upward and downward forces to ensure that the installation plan is adequate. Many installers look to UST manufacturers to provide this information.

The Petroleum Equipment Institute has published an example on the calculation of buoyancy and buoyancy safety factors. The relevant publication is PEI 100-97, Recommended Practices for Installation of Underground Liquid Storage Systems, the contents of which are hereby incorporated by reference herein. The assignee of the present invention, Xerxes Corporation, has automated some of these calculations in the form of spreadsheets in the past. However, the example and previous Xerxes applications do not address multiple tank installations, and do not account for such variables as double-walled tanks having annular monitoring spaces that may be filled with air, may be maintained with a vacuum, or may be filled with brine or other monitoring fluids.

What is needed is a general method and apparatus for calculating tank buoyancy and buoyancy safety factors that can easily verify that adequacy of a UST installation plan.

SUMMARY OF THE INVENTION

The invention meets the aforementioned problems to a great extent by providing a method for calculating UST buoyancy and buoyancy safety factors that can be implemented on a computer. In one embodiment of the invention, installation plan information is entered over a medium such as the Internet. The computer then calculates the buoyancy and buoyancy safety factor and returns this information to the requesting party over the same medium. This technique allows installers to verify the adequacy of installation plans quickly. Records of the information provided by the installer may be kept so the recipient of the information (typically the UST manufacturer) can reconcile differences between the actual installation and the installation plan in the event of UST flotation. In another embodiment of the invention, the information may be provided on a paper form supplied by the installer. In preferred embodiments, the calculations are tailored to installation guidelines (often provided by the UST manufacturer), which may specify such parameters as spacing between tanks in multi-tank installations, some or all deadman dimensions, slab dimensions, etc. Preferred embodiments of the invention also have the ability to generate a form letter that includes the installation plan information and the results of the buoyancy and/or buoyancy safety factor calculations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 8 is a report according to a preferred embodiment of the invention.

FIG. 18 is a diagram showing a blank input form according to a preferred embodiment of the present invention.

FIG. 19 is a diagram showing a completed input form of the type shown in FIG. 18.

DETAILED DESCRIPTION OF THE PREFERRED EMBODIMENTS

Figure 1:
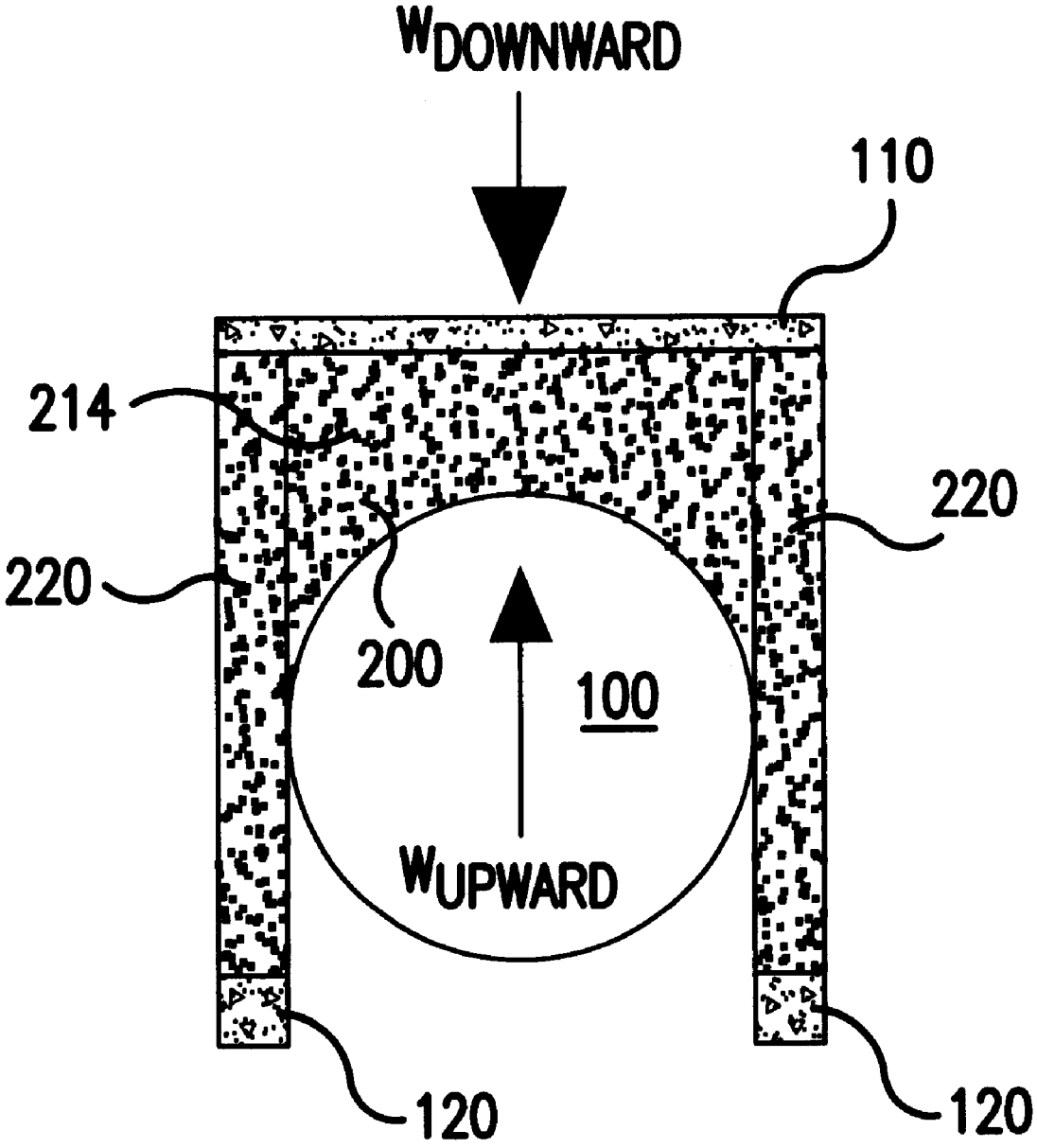
FIG. 1 is a "free body diagram" showing downward and upward forces acting on a UST.

Referring now to the drawings, wherein like reference numerals designate identical or corresponding parts throughout the several views, a typical installation of a tank 100 is shown in FIG. 1. In this example, the tank 100 is installed under a concrete slab 110 and is secured to two deadmen 120 with a plurality of straps (not shown in FIG. 1) at each deadman 120. Many other installation plans are also possible. In order to prevent tank flotation, the total downward force $W_{DOWNWARD}$ must exceed the total upward force $W_{UPWARD}$.

Figure 2:
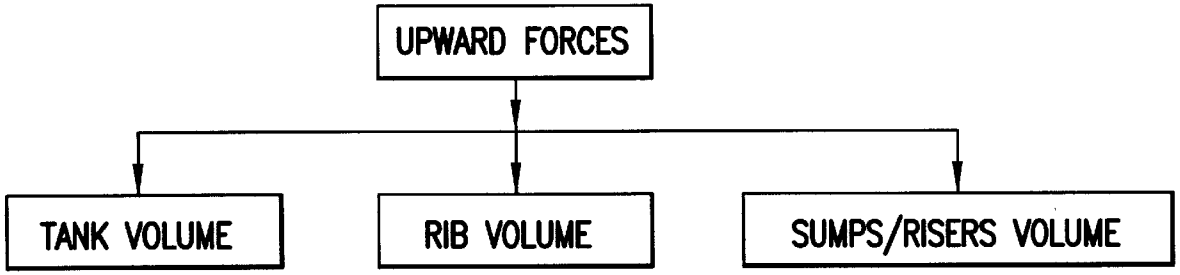
FIG. 2 is a block diagram showing various components of water displaced upward forces.

Upward forces acting on the tank 100 are a result of the total tank displacement volume multiplied by the weight of water. As shown in FIG. 2, the volume of the tank 100, the volume of any attached manways/sumps/risers, and the volume of tank ribs all contribute to the total tank displacement and thus to the total upward force $W_{UPWARD}$. Thus, the total upward force acting on a tank 100 with a total tank displacement (including contributions made by ribs and manways/sumps/risers) of 1,500 cubic feet is equal to 1,500 $cu^3$*62.4 $lb/cu^3$=93,600 lbs, where 62.4 $lb/cu^3$ is the weight of water. The total tank displacement is often available from the tank manufacturer.

Figure 3:
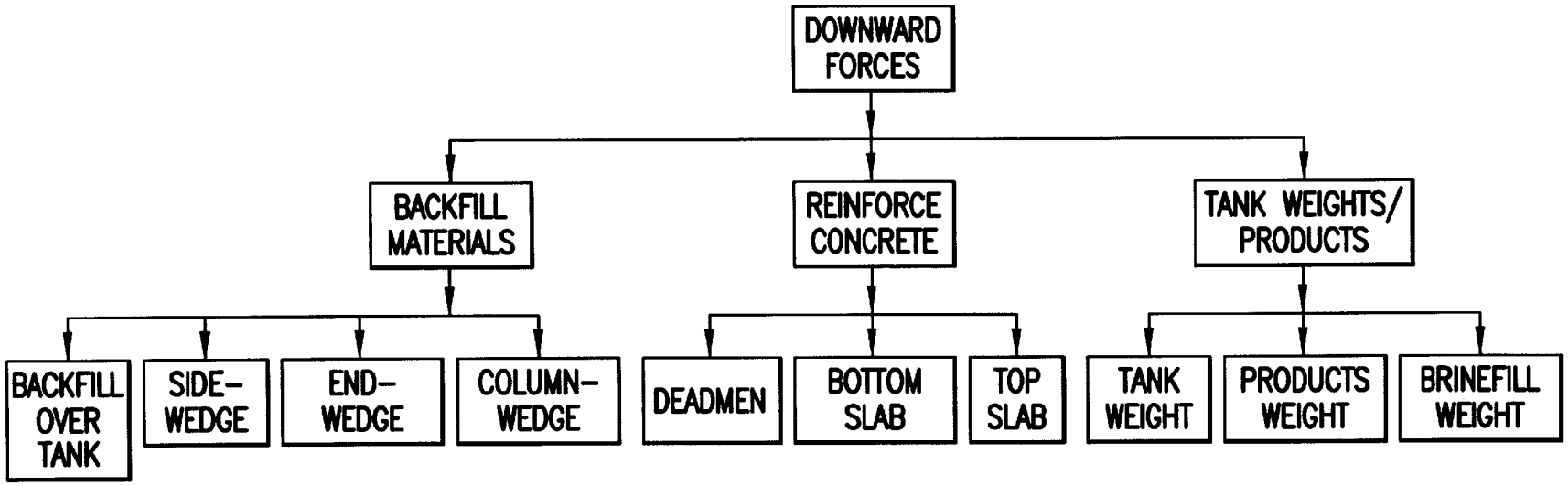
FIG. 3 is a block diagram showing various components of downward forces.

As shown in FIG. 3, downward forces acting on a tank 100 result from three main sources: 1) the weight of the tank and products; 2) the weight of reinforced concrete associated with the tank installation; and 3) the weight of backfill materials. The first source includes the weight of the tank itself as well as the weight of any monitoring fluid, such as brine, that may be included in the annular spaces of multi-wall tanks. If it is certain that a minimum amount of liquid material will be stored in the tank at all times (e.g., septic tanks, wastewater treatment tanks), then this minimum may be taken into account. However, for applications such as gasoline filling stations where no minimum storage can or should be assumed, the weight of products to be stored in the tank is ignored. The second source includes the weight of all reinforced concrete or other material included in top slabs (slabs placed above a tank), bottom slabs (slabs placed below a tank) and deadmen. The third source includes the weight of backfill materials, including the weight of backfill directly over the tank, side wedges, end wedges and column wedges over the tank and deadmen. These terms will be explained below in connection with various tank installations.

In preferred embodiments, the weight of various materials is assumed to be as indicated in the following table:

| Material | Weight (pound per cubic foot) |
|---|---|
| Reinforced Concrete (dry) | 150 |
| Reinforced Concrete (submerged in water) | 88 |
| Pea Gravel (dry) | 100 |
| Pea Gravel (submerged in water) | 60 |
| Water | 62.4 |

Weights for reinforced concrete and pea gravel (which is often recommended as a backfill material by tank manufacturers) are given for both dry and submerged in water conditions. The program must use the appropriate value for the installation. For example, where deadmen are used and the deadmen are below the water table, the submerged value should be used. In contrast, the dry value for reinforced concrete should be used when a top slab is installed and the water table is below the top slab. Furthermore, the effects of soil friction around the outside of the installation are ignored in preferred embodiments since the resultant forces are small. Since soil friction is a downward force, ignoring the effects of soil friction will yield a more conservative estimate.

Figure 4A:
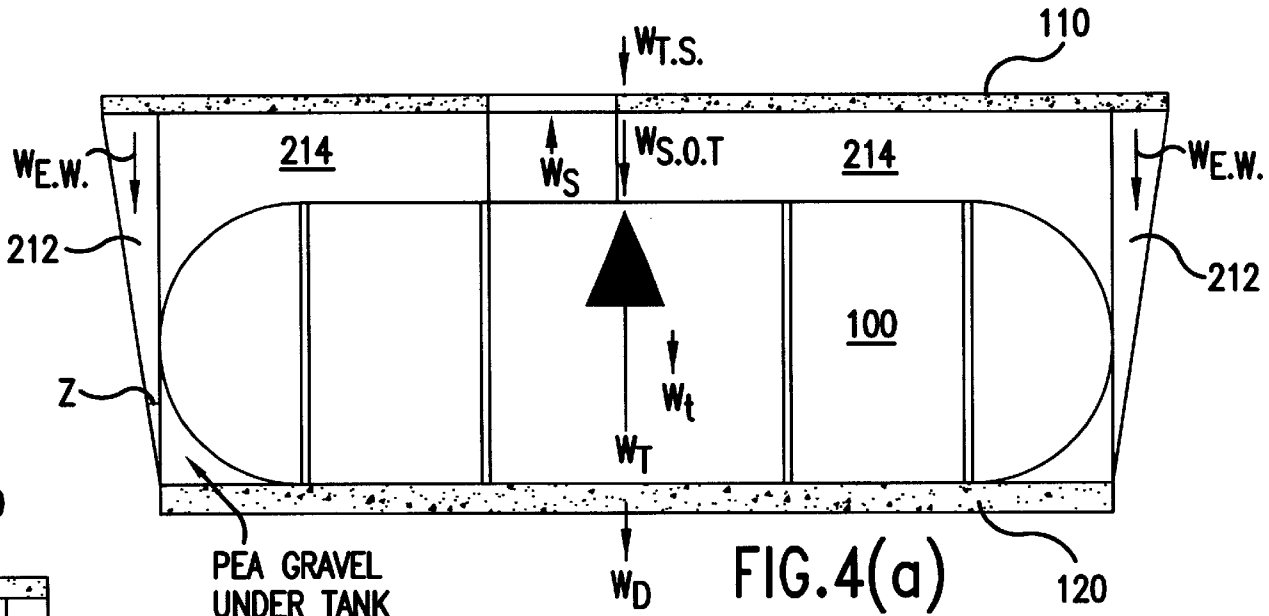
FIG. 4 is a "free body diagram" showing the components of FIGS. 2 and 3.
Figure 4B:
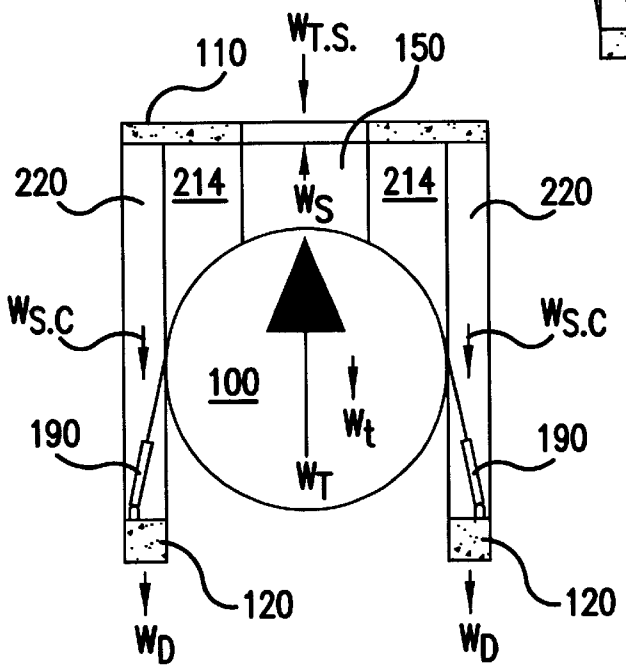

FIG. 4 is a free body diagram showing the upward and downward forces broken down by their sources. The total upward force $W_{UPWARD}$ results from the weight of water displaced by the tank $W_T$ and the sump $W_S$. The total downward force results from the weight $W_t$ of the tank 100 (including the attached sump), the weight $W_{T.S.}$ of the top slab 110, the weight $W_D$ of the deadmen 120, the weight $W_{S.C}$ of the backfill side columns 220 over the deadmen, the weight $W_{S.O.T.}$ of the backfill in regions 214 on top of the tank, and the weight $W_{E.W.}$ of the backfill in the end wedge areas 212. It should be noted that the volume of backfill under the tank 100 plays no part in the calculations in the absence of a bottom slab (not shown in FIG. 4). Non-inclusion of the backfill under the haunches is de minimus and conservative. The calculation of the volumes of areas of backfill over the tank and the column and end wedges once the angle is specified is well known to those of skill in the art.

The dimensions of the side column areas 220 depend upon the dimensions of the deadmen. The dimensions of the end wedge areas 212 and side wedges 218 (discussed in further detail below) depend upon the internal friction properties of the backfill. The program could be configured to accept the deadman dimensions and backfill friction characteristics from the user, but inputting all of these dimensions can be laborious and/or difficult to determine (in the case of backfill friction) for the user. In preferred embodiments of the program, assumptions about the dimensions of the deadmen are made based upon a selected set of installation instructions. In other words, where a tank manufacturer recommends a deadman size, the program may be configured to assume that the installation instructions are followed. Soil friction for the backfill material may also be estimated by choosing a conservative angle of inclination (as used herein, angle of inclination refers to the angle formed by the intersection of a vertical axis and an inclined boundary of a wedge section such as the angle Z of FIG. 4*a*) for the side and end wedges. Soil mechanics studies have shown that under certain conditions, angles of inclination as high as 45 degrees are appropriate for defining side and end wedge areas. However, a conservative estimate of the angle of inclination ranges from 15 to 30 degrees. In preferred embodiments of the program, the angle of inclination may be selected by taking the lesser of 30 degrees and the angle formed by setting the horizontal width of the wedge equal to the spacing between the edge of the installation excavation and the surface of interest (the edge of a tank or the edge of a bottom slab) or, in the case of side wedges between tanks in multi-tank installations, by setting the horizontal width of the wedge equal to one half of the spacing between tanks in multi-tank installations. Examples of side and edge wedge definitions will be discussed in further detail below.

Figure 5:
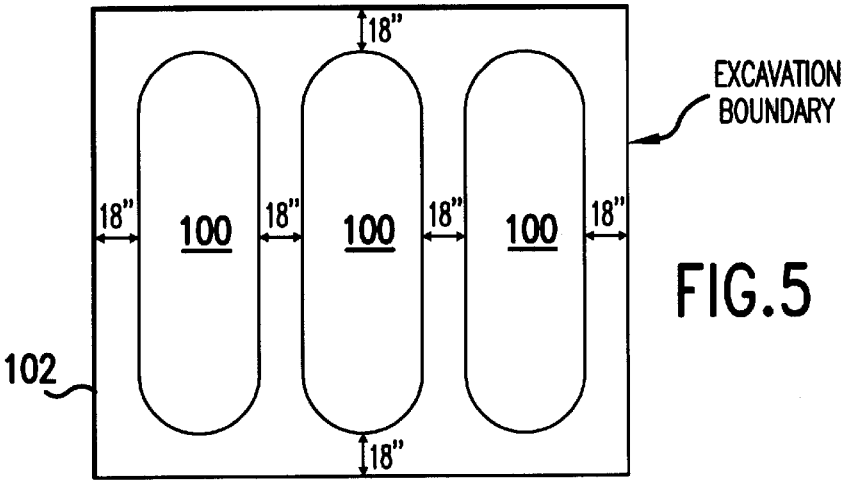
FIG. 5 is a plan view of a first typical multitank installation plan.
Figure 6:
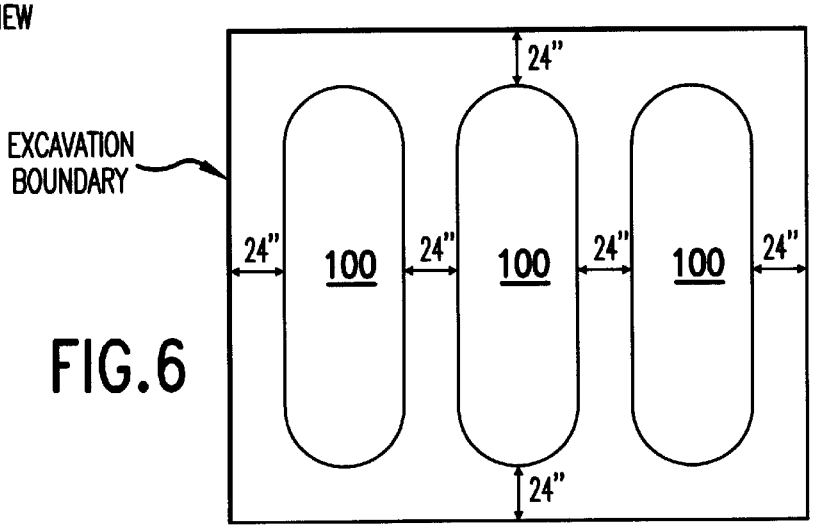
FIG. 6 is a plan view of a second typical multitank installation plan.
Figure 7:
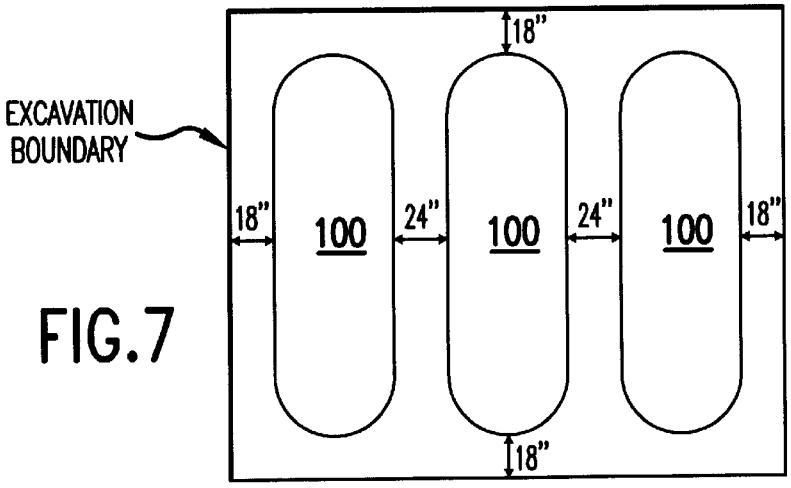
FIG. 7 is a plan view of a third typical multitank installation plan.

In multi-tank installations, assumptions about the spacing of the tanks can also be made based upon the tank manufacturer's recommended tank spacing. An example of a possible manufacturer-recommended multi-tank installation is shown in FIG. 5, in which three tanks 100 are installed in an excavation 102 such that each tank 100 is separated by 18" from each other tank and an 18" border is provided between the end of a tank 100 and the boundary of the excavation 102. Another possible recommended installation plan is shown in FIG. 6, in which each tank 100 is separated from neighboring tanks 100 by 24" and a 24" border is left between tanks 100 and the boundary of the excavation 102. This installation plan is derived from PEI 100-97. The plans depicted in FIGS. 5 and 6 may need modification depending upon installation options. For example, in the plan of FIG. 5, the manufacturer recommends two deadmen (one on each side of the tank 100), each with a 12"×12" cross-sectional dimension, for certain tanks. Thus, to ensure that the deadmen for neighboring tanks do not overlap, the spacing between tanks must be 24", as shown in FIG. 7. All other dimensions may remain the same. Again, in preferred embodiments, the program automatically assumes this modification for the manufacturer-recommended installation plan based upon the tank size when deadmen are specified as the anchoring system. The PEI installation plan shown in FIG. 6 does not require modification because 24", rather than 12", is the recommended spacing between tanks and the recommended deadman cross-sectional width is 12".

Figure 11:
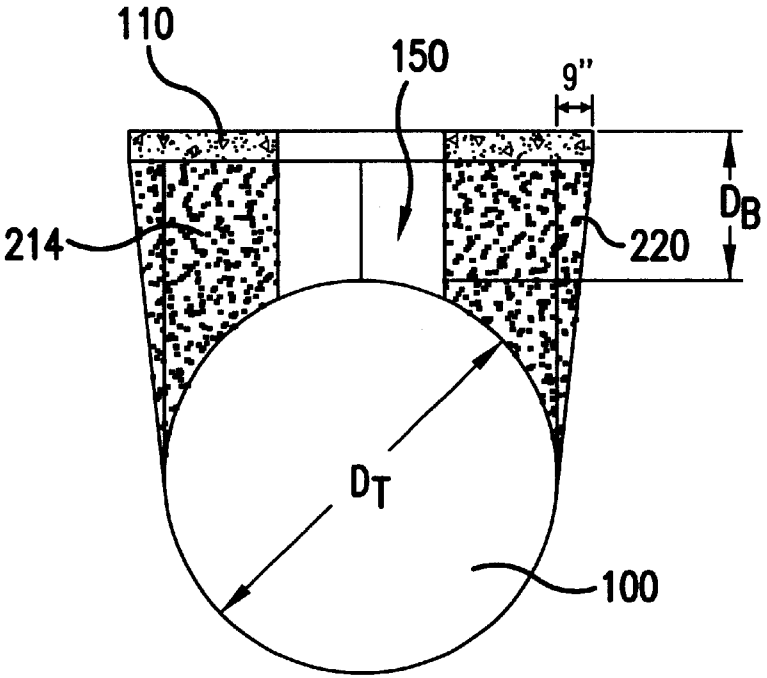
FIGS. 11 and 12 are end and side views, respectively, of a tank installed according to the plan of FIG. 5.
Figure 9:
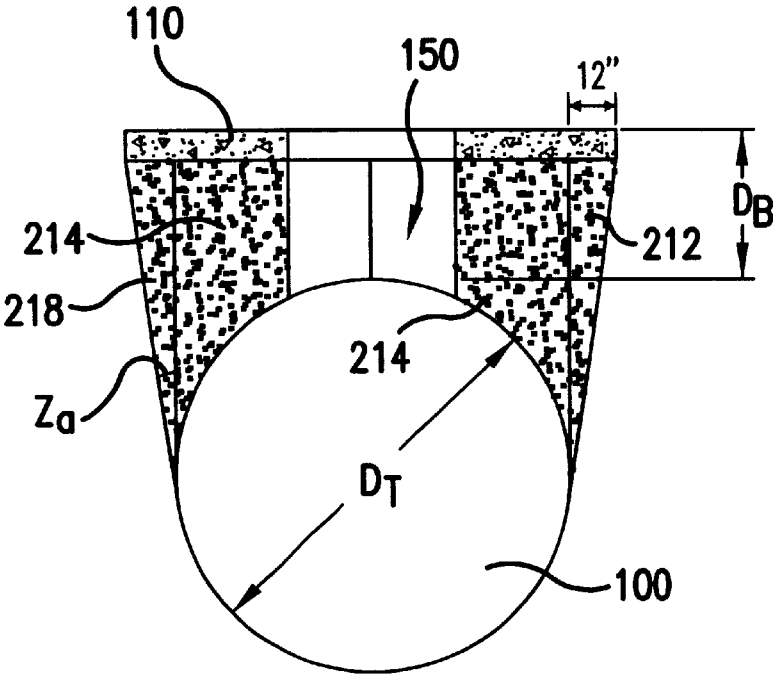
FIGS. 9 and 10 are end and side views, respectively, of a tank installed according to the plan of FIG. 6.
Figure 10:
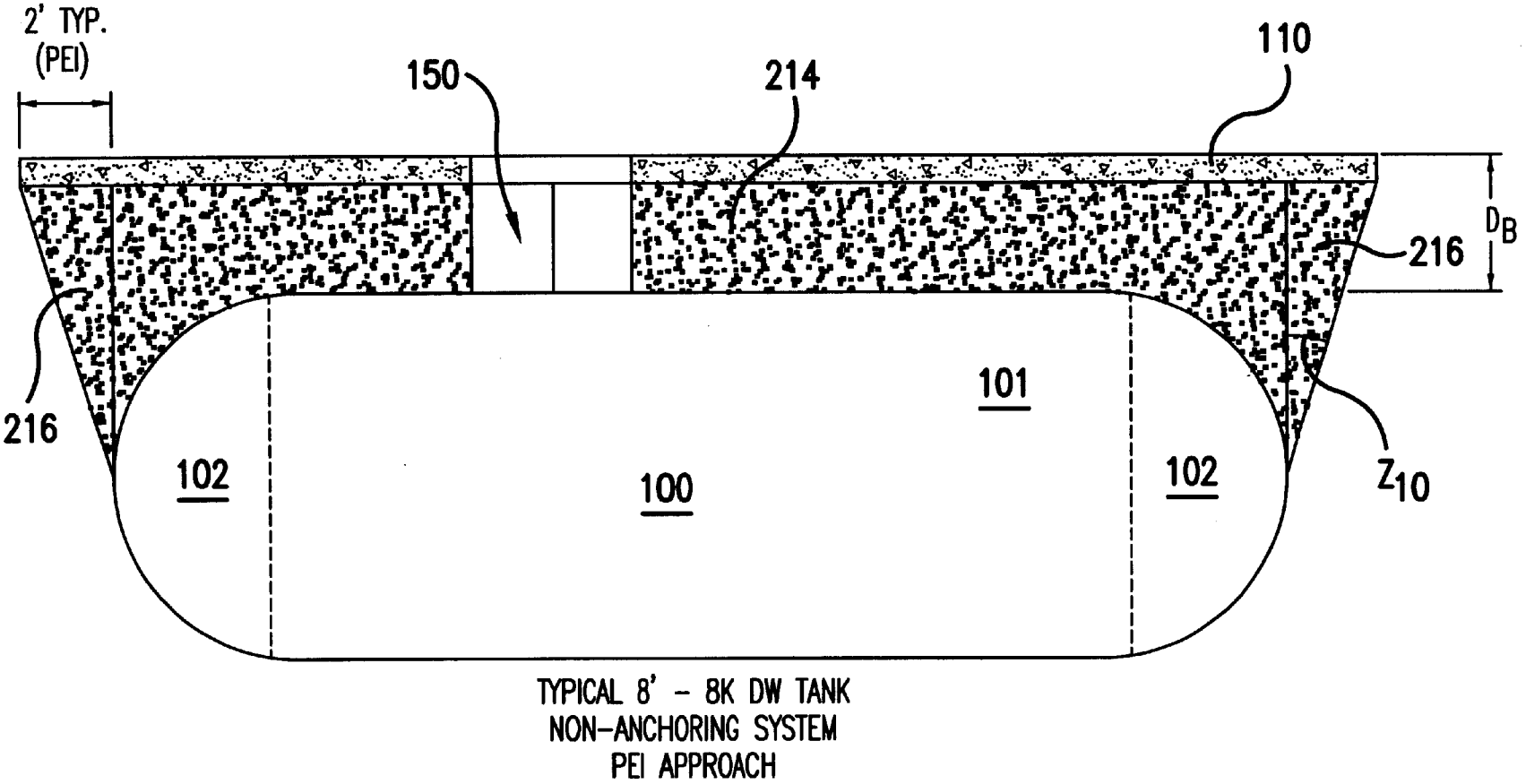
Figure 12:
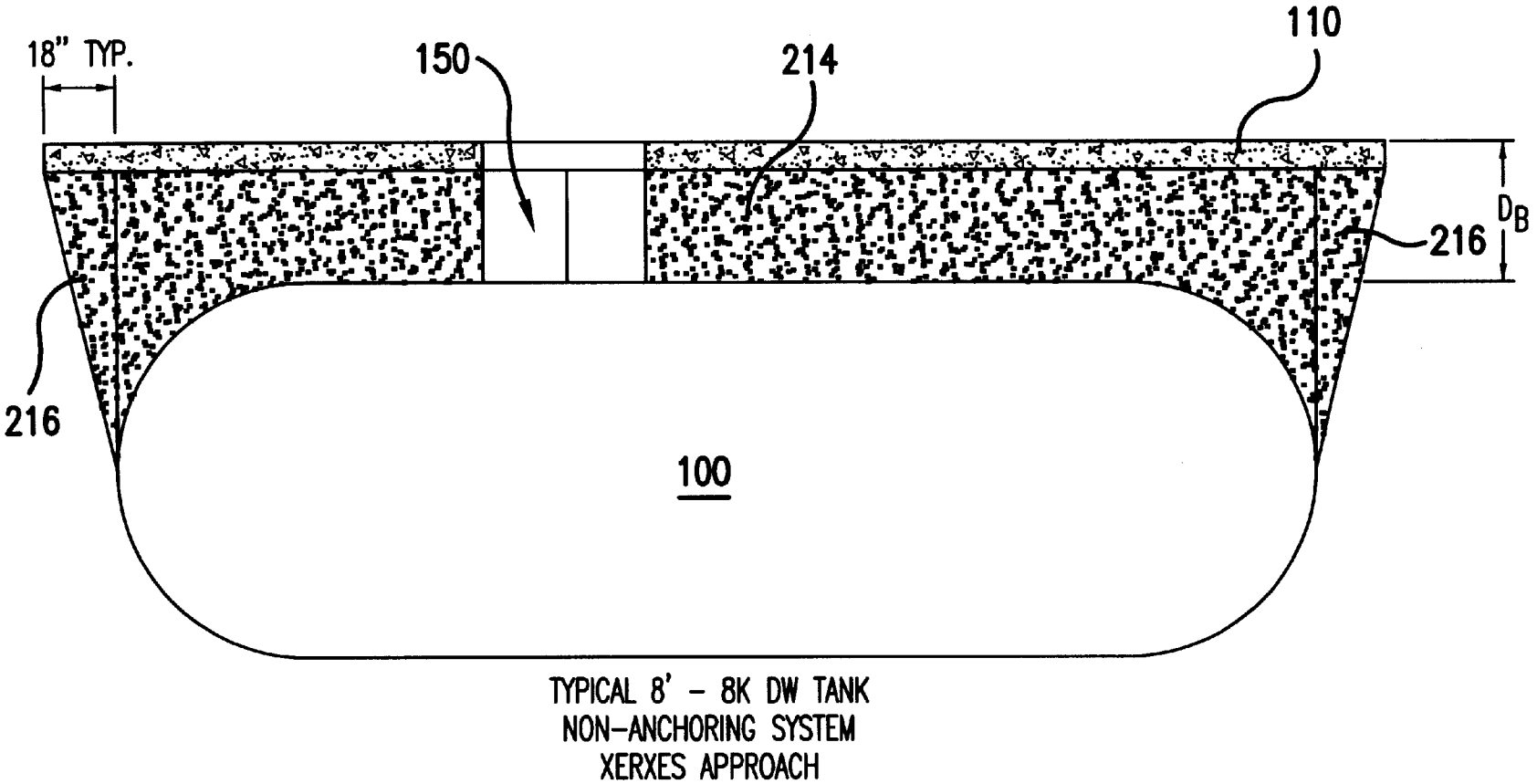

The volumes of side wedges, end wedges, and side columns for various installation permutations will now be discussed in further detail. FIGS. 9 (end view) and 10 (side view) illustrate a typical non-anchored (i.e., no deadmen or bottom slab) multi-tank installation of a tank 100 according to the recommendations published by PEI. The installation of FIGS. 9 and 10 includes a top slab 110. The maximum width of the side wedge 212 is shown as 12" in FIG. 9. Because the PEI recommends a 24" spacing between tanks in multi-tank installations, only half of the backfill between tanks can be allocated to any one tank; therefore, 12" is used since 12" is half of 24". The angle of inclination $Z_9$ of the side wedge 212 using the 12" width and a height of 7 feet (the tank is an 8 foot diameter tank and the burial depth $D_B$ is three feet) is approximately 8 degrees, so there is no need to limit the dimensions of the side wedge 212 to ensure a maximum angle of inclination of 30 degrees. Referring now to FIG. 10, the width of the end wedge 216 is two feet and the depth is again 7 feet, so the angle of inclination $Z_{10}$ is approximately 16 degrees, again below the maximum. Once the boundaries of the end wedges 216 and side wedges 212 are defined, the calculation of the volumes and forces is straightforward and well known to those of ordinary skill in the art. FIGS. 11 and 12 show a similar installation, the difference being that a manufacturer-recommended 18" spacing is left between tanks 100 and between the edges of tanks 100 and the installation excavation (not shown in FIGS. 11 and 12). The width of the side wedge 212 of FIG. 11 is assumed to be 9" and the width of the end wedge 216 of FIG. 12 is assumed to be 18". The angles of inclination for these wedges are approximately 6 and 12 degrees, respectively, and thus do not exceed the 30 degree maximum.

Figure 17:
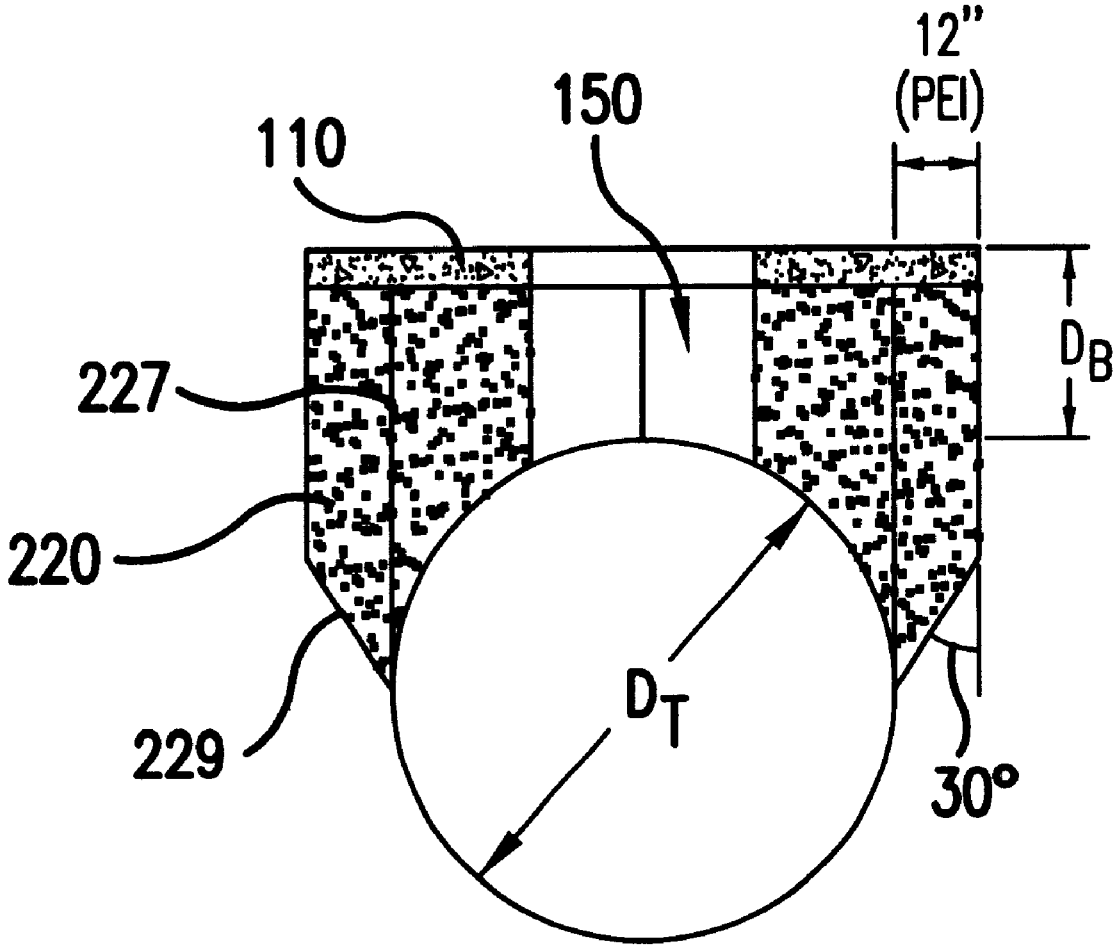
FIG. 17 is an end view showing a boundary of a side wedge according to an embodiment of the present invention.

A less conservative, but acceptable, alternative method for calculating side wedges 220 in a multi-tank installation is shown in FIG. 17. The boundaries of the side wedges 220 are set by an intersection of a vertical line 227 formed halfway (e.g., 12") between adjacent tanks 100 and a line 229 with a 30 degree angle of inclination.

Figure 13:
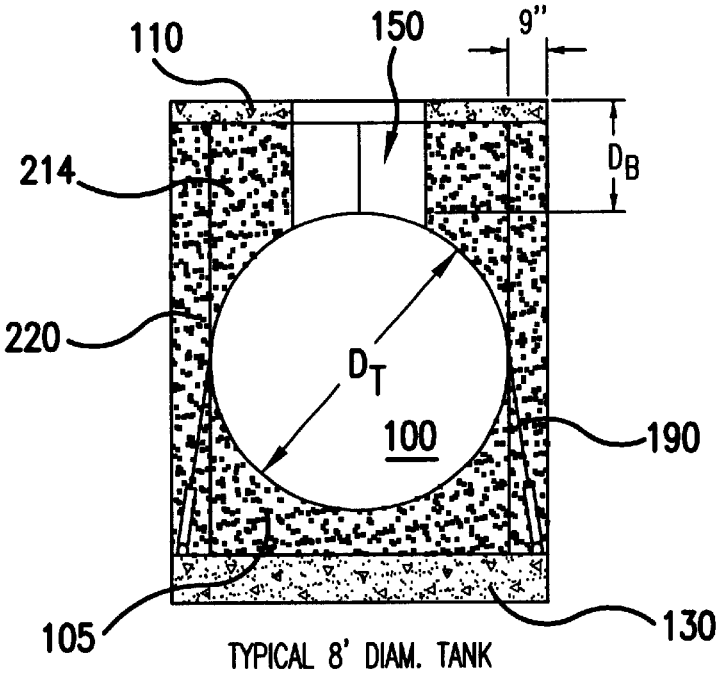
FIGS. 13 and 14 are end and side views, respectively, of a tank installed according to the plan of FIG. 5.
Figure 14:
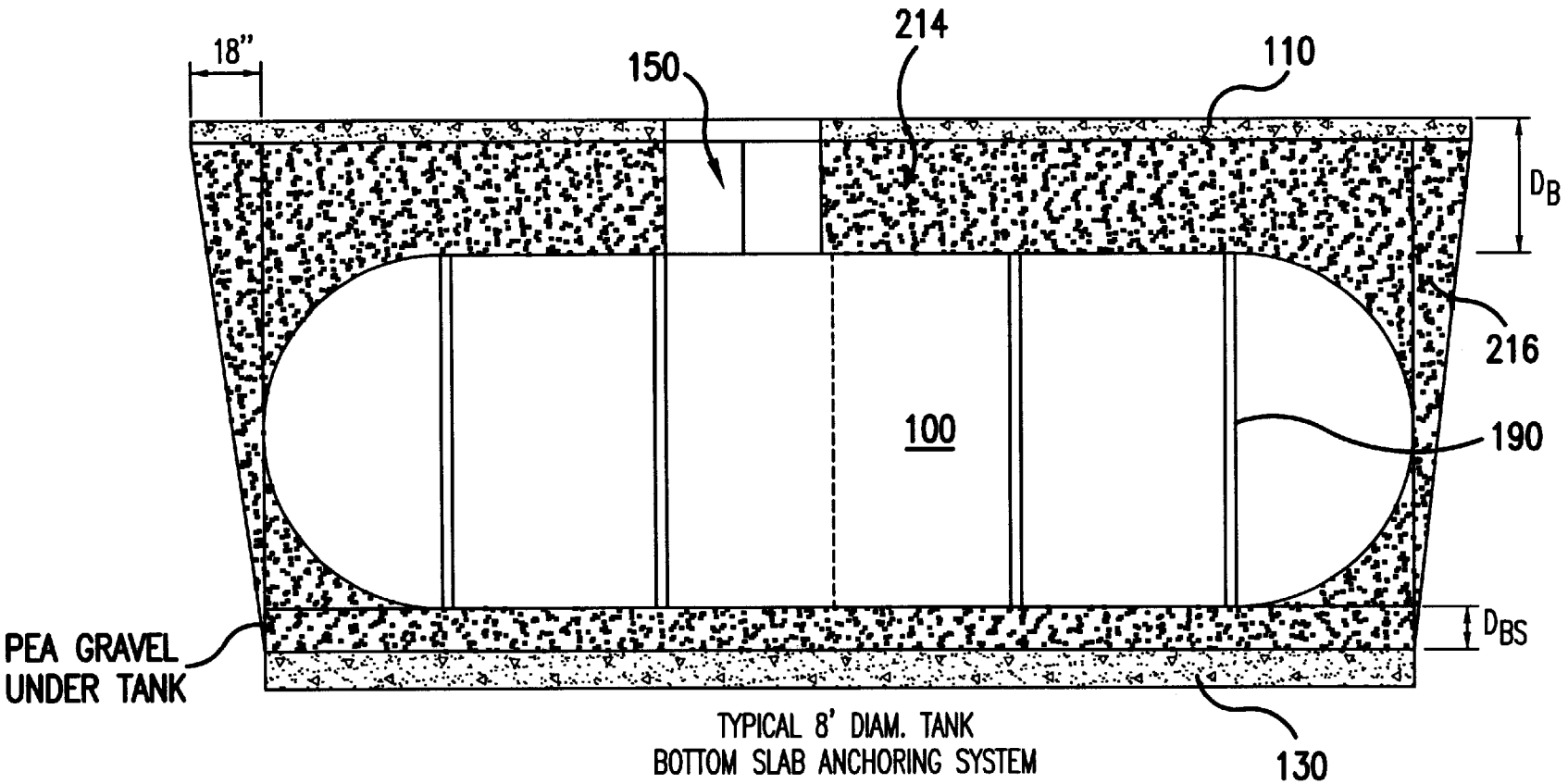

FIGS. 13 and 14 illustrate an installation (part of a multi-tank group) employing a bottom slab 130 and a top slab 110. In this case, the widths of the top slab 110 and the bottom slab 130 are equal and exceed the width of the tank 100 as shown in FIG. 13, so no side wedges are included. The horizontal width of the end wedge 216, as shown in FIG. 14, is 18" (according to manufacturer installation instructions), and the depth of the end wedge 216 is 12 feet (8 foot tank diameter and 3 foot burial depth $D_B$ and 1 foot depth of pea gravel bedding $D_{BS}$ as measured relative to the bottom of the tank 100). In this case, the pea gravel under the haunches 105 would be included.

Figure 15:
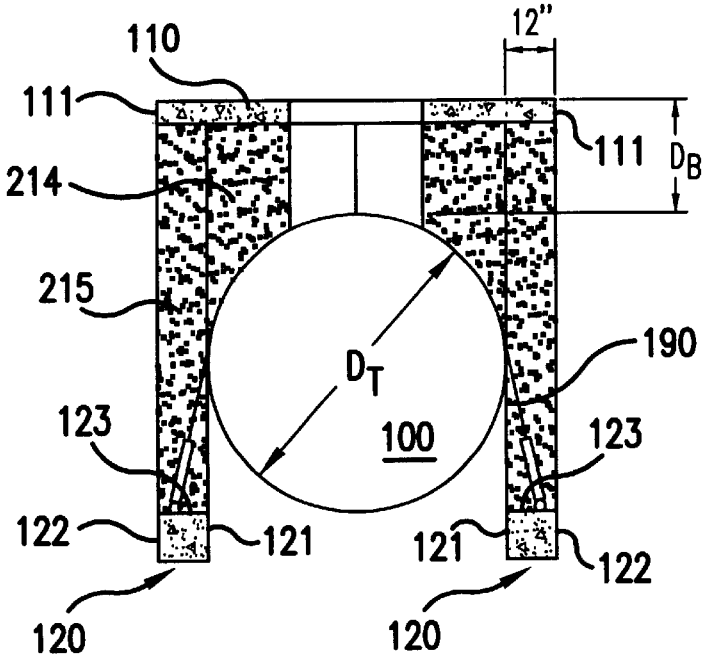
FIGS. 15 and 16 are end and side views, respectively, of a tank installed according to the plan of FIG. 7.
Figure 16:
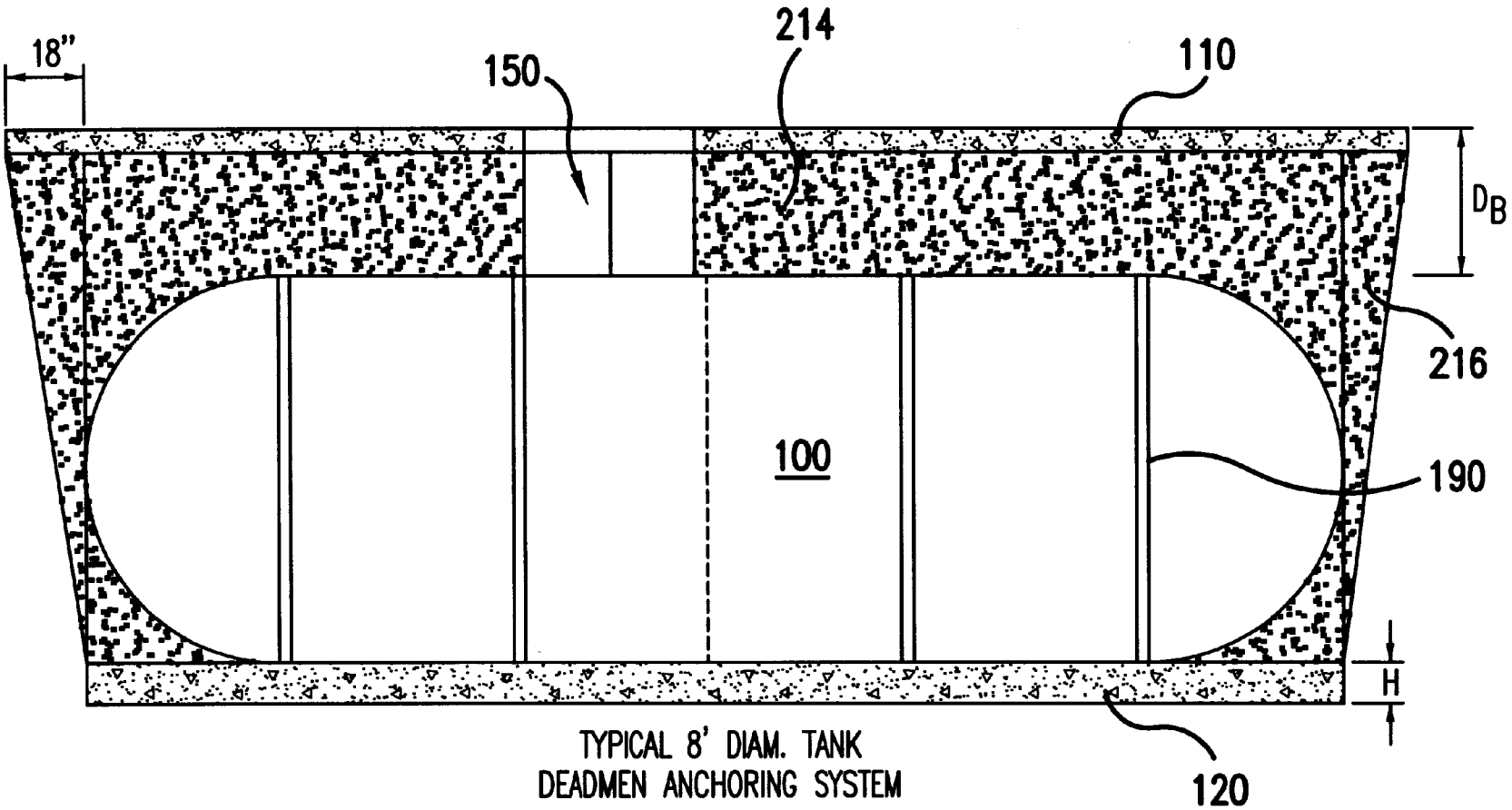

FIGS. 15 and 16 show an installation (part of a multi-tank group) employing a top slab 110 and two deadmen 120, one on each side of the tank 100 and secured thereto by straps 190. Typical cross sectional dimensions for deadmen 120 for an 8 foot diameter tank are 12"×12". The deadmen 120 are arranged such that an inside edge 121 is vertically aligned with an edge of the tank 100. The deadmen 120 are often installed such that outside edges 122 of deadmen 120 from neighboring tanks are adjacent; therefore, the boundary of the side column 215 is vertically aligned with the outside edge 122 of the deadmen 120. The width of the side columns 215 is therefore equal to the width of the deadmen 120. The deadmen 120 are installed such that their top surfaces 123 are horizontally aligned with the bottom of the tank 100; thus, the height of the side columns 215 is equal to the diameter $D_T$ of the tank 100 plus the burial depth $D_B$.

The information concerning a planned installation must be input to the calculation program. As discussed above, this input may be accomplished in several ways. In one preferred embodiment, an installer is provided with a form tailored for a particular manufacturer such as the form 1800 shown in FIG. 18. The form 1800 includes a background information block 1810 in which the date, customer, tank location, installation contractor and other like information is recorded. The form 1800 also includes a representative diagram 1820 that includes reference letters A–H that correspond to specific fields in the installation information block 1830 below relating to various installation options and dimensions. In field A, the tank size and type (e.g. single wall SW, double wall DWT-I, or double wall DWT-II) corresponding to various manufacturer-specific tank types, as well as whether the annulus (applicable to double walled tanks) is brine filled, is recorded. The burial depth $D_B$ is recorded in field B. The number of attached collar risers (also referred to herein as sumps and manways), as well as their diameter (a typical manufacturer may offer more than two sizes) is recorded in field C. The thickness and composition (e.g., asphalt or concrete) of the top slab 110 is recorded in field D. The backfill type (e.g. sand, pea gravel, etc.) and ballast amount and type are recorded in field E. [Ballast refers to any liquid or other material that is present in the tank during installation and which is certain to be in the tank at all times. Ballast is generally not included in the calculations because in most applications there will be some circumstances in which the tank can be expected to be empty.] The height of the water table at the installation location is recorded in Field F. The dimensions of any deadmen are recorded in field G and the bottom slab dimensions and tank spacing (filled in for a multitank installation) are indicated in field H (only reinforced concrete is recommended for a bottom slab by the typical manufacturer). An exemplary completed form 1900 is shown in FIG. 19.

The form 1800 may be filled in by a contractor and mailed to a company so that the data may be input to the program by a company employee. This method of entering the data ensures that there is a written record of the information supplied by the contractor. In a second preferred embodiment, the program includes an entry screen similar to the form 1800 which may be made available to contractors over a medium such as the Internet. This method has the advantage of allowing contractors to get installation plan information quickly, which can be important when an unforseen development requires installation plan modification. The program can still save a record of the installation plan information provided by the contractor, which might be in dispute if the installation is not successful. Of course, fax transmission is also available.

Although the method for calculating the buoyancy safety factor may be performed manually, the method is implemented in a computer program in preferred embodiments. The operation of the program will now be discussed with reference to FIGS. 20–22. The program may be designed for and run on any computer, but is implemented on a personal computer (PC) such as a Pentium®-based PC in preferred embodiments. In highly preferred embodiments, the method is performed using a spreadsheet program such as Microsoft® Excel®.

Figure 20:
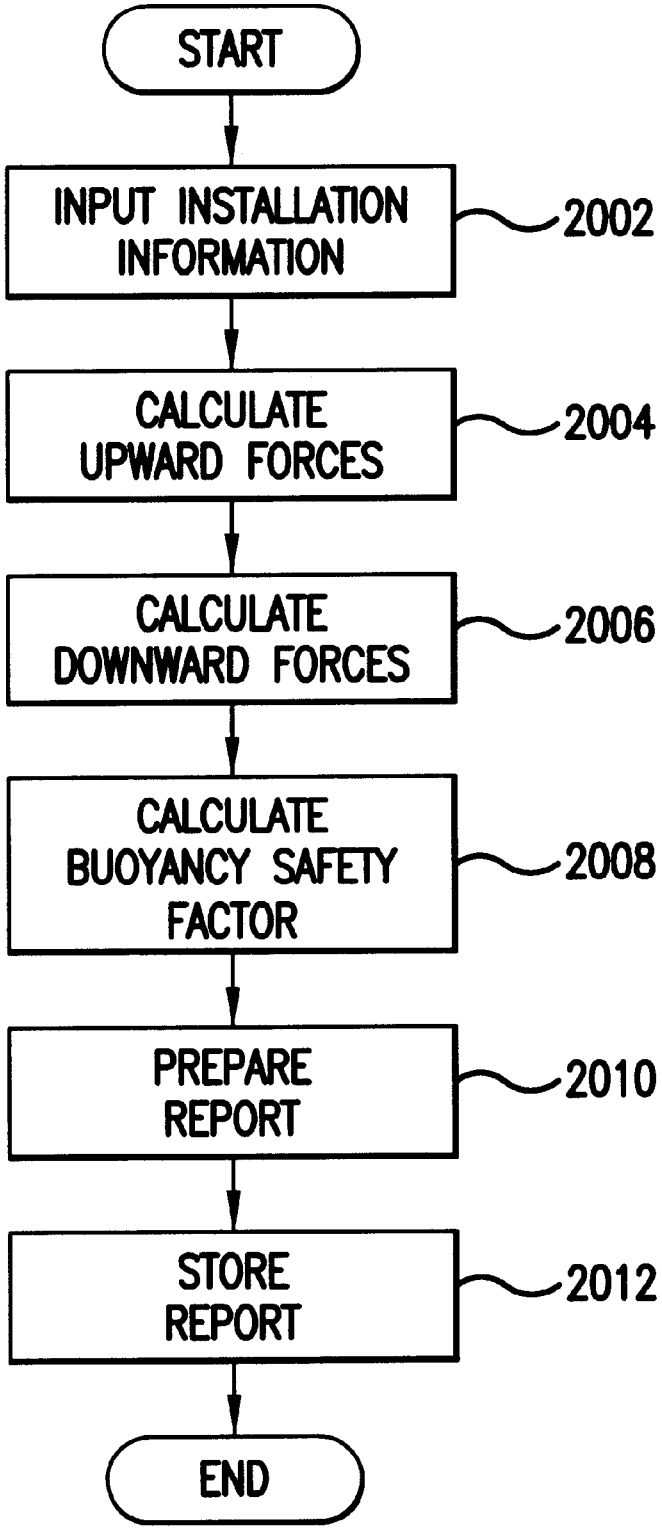
FIG. 20 is a flow chart showing the steps for calculating a UST buoyancy safety factor according to a preferred embodiment of the present invention.
Figure 21:
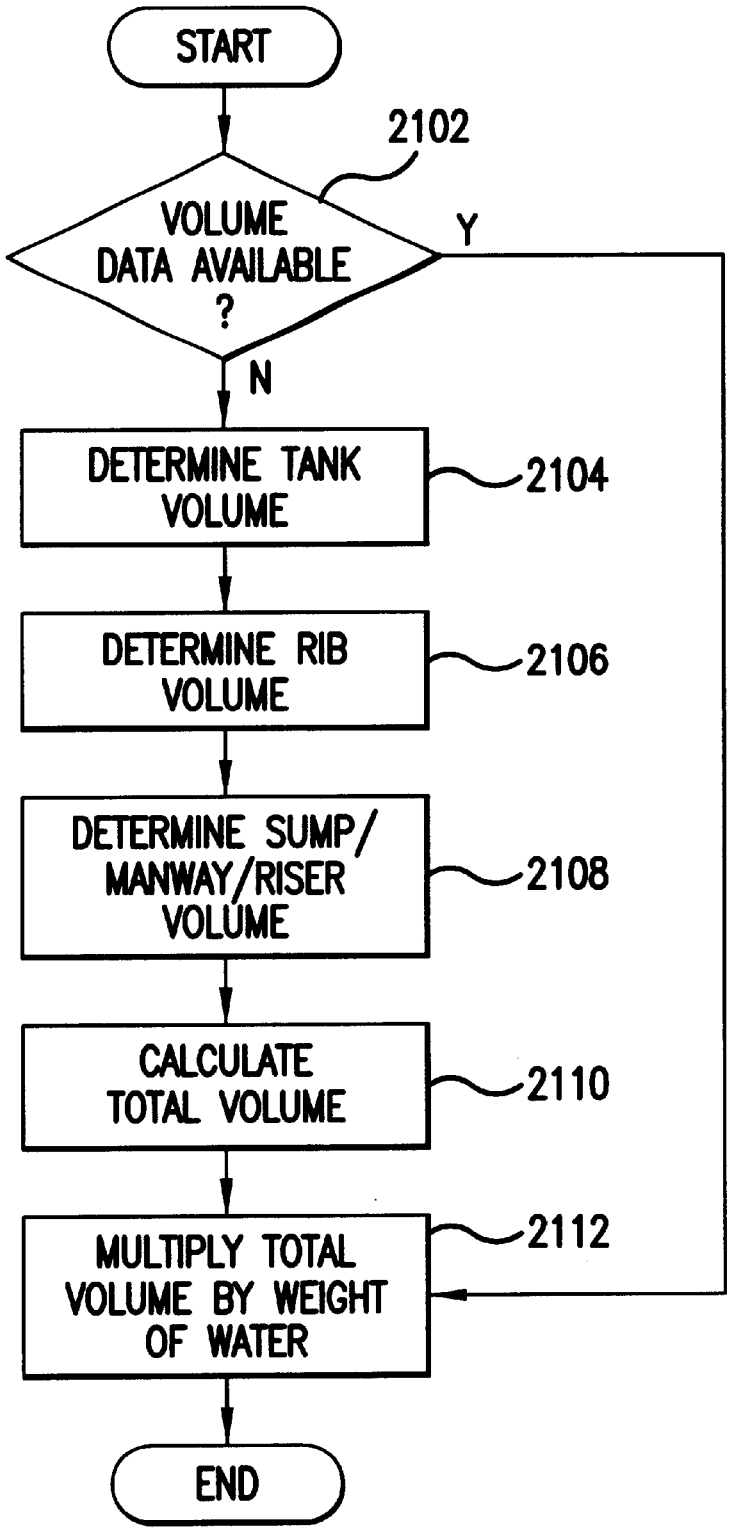
FIG. 21 is a flow chart showing one of the steps of FIG. 20 in greater detail.
Figure 22:
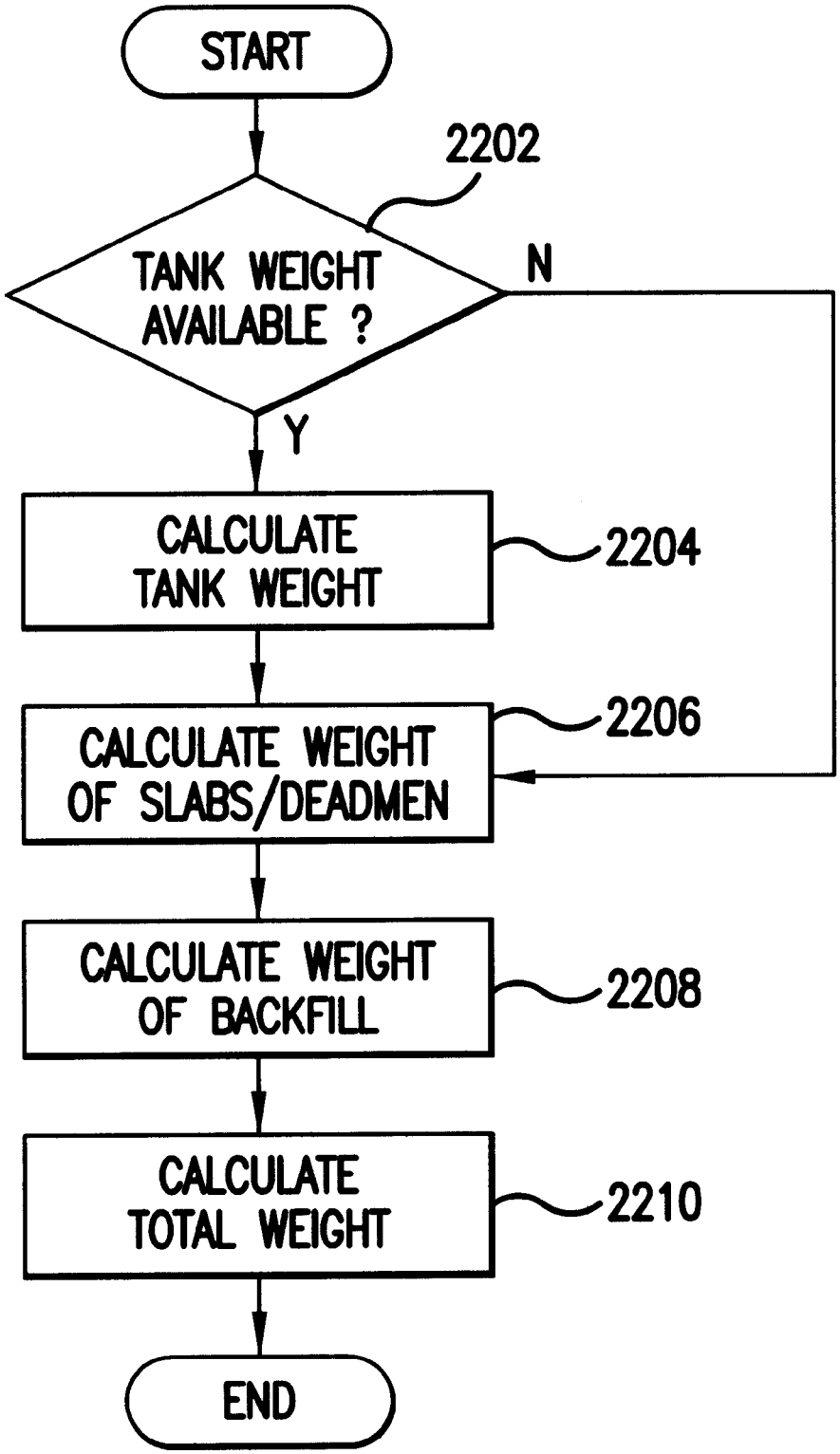
FIG. 22 is a flow chart showing another of the steps of FIG. 20 in greater detail.

Referring now to FIG. 20, the installation information is input at step 2002. As discussed above, the input may occur from a remote location over a media such as the Internet, or may occur at the PC. The upward forces are calculated at step 2004. A more detailed description of step 2004 is shown in FIG. 21 and will be discussed below. The downward forces are calculated at step 2006. As for step 2004, a more detailed description of step 2006 is shown in FIG. 22 and will be discussed below. The buoyancy safety factor is calculated by taking the ratio of downward forces to upward forces at step 2008.

In preferred embodiments, a report is then generated at step 2010. An example of such a report is shown in FIG. 8. The report includes the name of the party requesting the information and lists the buoyancy safety factor calculated on the basis of the information supplied by the requesting party. Techniques for creating such automated reports are well known in the art and will not be discussed in further detail herein. After the report is created, it is stored at step 2012.

The calculation of the upward forces, step 2004 above, will now be discussed in more detail with reference to FIG. 21. First, the program determines whether volume data for the tank, ribs and risers (if any) is available from the manufacturer or other source at step 2102. This will be the case in applications that are tailored for a particular manufacturer. If the volume information is not available, the tank volume is determined at step 2104, then the rib volume is determined at step 2106, and finally the sump/manway/riser volume is determined at step 2108. These volumes may be calculated using standard techniques well known to those of ordinary skill in the art and will not be discussed further herein. It is of course necessary to adjust the volumes for the height of the water table so that the submerged volume is calculated. The volumes are then added at step 2110. Finally, the total volume, whether obtained from the manufacturer or separately determined, is multiplied by the weight of water (or any other material being displaced) per unit volume.

The calculation of the downward forces, step 2006 above, will now be discussed in more detail with reference to FIG. 22. First, the program determines whether the tank weight, including any fluid in annular spaces for double walled tanks, is available at step 2202. If the weight is not available from the manufacturer, the weight is calculated at step 2204. This step may include simply adding the weight of monitoring fluid such as brine in double walled tanks to the weight of the tank; but may also include calculating the weight of the tank itself based on the dimensions of the tank. Next, the weight of any slabs or deadmen is calculated at step 2206. Then the weight of backfill over the tank and in side wedges, end wedges and/or side columns is calculated at step 2208. Finally, the weight is summed at step 2210.

Obviously, numerous modifications and variations of the present invention are possible in light of the above teachings. It is therefore to be understood that within the scope of the appended claims, the invention may be practiced otherwise than as specifically described herein.

What is claimed is:

1. A method for calculating a buoyancy safety factor for a tank to be installed underground comprising the steps of:

inputting tank installation information, the installation information including spacing between the tank to be installed and other tanks in multiple tank installations;

determining a weight of the tank to be installed, the weight including the weight of any annular monitoring fluid associated with the tank to be installed;

determining a weight of backfill on top of the tank to be installed and a weight of backfill in any side wedge volumes, end wedge volumes, and side column volumes, the side wedge volumes and side column volumes having boundaries defined such that the boundaries do not overlap side wedge volume or side column volume boundaries of other tanks in multiple tank installations;

determining a weight of any top slab, bottom slab or deadman to be installed;

determining a weight of any water displaced by the installation of the tank including any water displaced by any tank ribs and any manways associated with the tank; and calculating a buoyancy safety factor by calculating the ratio of the weights of the tank, backfill, slabs and deadmen to the weight of any water displaced by the installation of the tank.

2. The method of claim 1, wherein a horizontal boundary of a side wedge volume is defined as one half of a distance between a planned position of the tank to be installed and a planned position of an other tank nearest to the side wedge volume.

3. The method of claim 2, wherein a vertical boundary of a side wedge volume is defined by a line segment having a first endpoint at an edge of the horizontal boundary and a second endpoint at an outermost edge of the tank to be installed in its corresponding planned position.

4. The method of claim 2, wherein a vertical boundary of a side wedge volume is defined by a first line segment and a second line segment connected at a common point, the first line segment having a first endpoint at an edge of the horizontal boundary, the second line segment having a second endpoint at an outermost edge of the tank to be installed in its corresponding planned position, and the common point is located at an intersection between a vertical line passing through the first endpoint and a line passing through the second endpoint and having an angle of inclination of approximately 30 degrees.

5. The method of claim 1, wherein the weight of any deadman to be installed is determined by multiplying a weight per unit volume of a material from which the deadman is constructed by a volume corresponding to a manufacturer's recommended volume for a deadman for the tank to be installed.

6. The method of claim 1, wherein the inputting step is performed by receiving the installation information over the Internet.

7. The method of claim 1, further comprising the step of preparing a report, the report including the buoyancy safety factor.

8. A system for calculating a buoyancy safety factor for a tank to be installed underground, the system comprising:

an input device for receiving tank installation information;

a memory for storing tank installation information;

a processor connected to the memory and the input device, the processor being configured to perform the steps of inputting tank installation information, the installation information including spacing between the tank to be installed and other tanks in multiple tank installations;

determining a weight of the tank to be installed, the weight including the weight of any annular monitoring fluid associated with the tank to be installed;

determining a weight of backfill on top of the tank to be installed and a weight of backfill in any side wedge volumes, end wedge volumes, and side column volumes, the side wedge volumes and side column volumes having boundaries defined such that the boundaries do not overlap side wedge volume or side column volume boundaries of other tanks;

determining a weight of any top slab, bottom slab or deadman to be installed;

determining a weight of any water displaced by the installation of the tank including any water displaced by any tank ribs and any manways associated with the tank; and calculating a buoyancy safety factor by calculating the ratio of the weights of the tank, backfill, slabs and deadmen to the weight of any water displaced by the installation of the tank.

9. The system of claim 8, wherein a horizontal boundary of a side wedge volume is defined as one half of a distance between a planned position of the tank to be installed and a planned position of an other tank nearest to the side wedge volume.

10. The system of claim 9, wherein a vertical boundary of a side wedge volume is defined by a line segment having a first endpoint at an edge of the horizontal boundary and a second endpoint at an outermost edge of the tank to be installed in its corresponding planned position.

11. The system of claim 9, wherein a vertical boundary of a side wedge volume is defined by a first line segment and a second line segment connected at a common point, the first line segment having a first endpoint at an edge of the horizontal boundary, the second line segment having a second endpoint at an outermost edge of the tank to be installed in its corresponding planned position, and the common point is located at an intersection between a vertical line passing through the first endpoint and a line passing through the second endpoint and having an angle of inclination of approximately 30 degrees.

12. The system of claim 8, wherein the weight of any deadman to be installed is determined by multiplying a weight per unit volume of a material from which the deadman is constructed by a volume corresponding to a manufacturer's recommended volume for a deadman for the tank to be installed.

13. The system of claim 8, wherein the input device is connectable to the Internet and the inputting step is performed by receiving the installation information over the Internet.

14. The system of claim 8, further comprising the step of preparing a report, the report including the buoyancy safety factor.

15. The system of claim 14, further comprising the step of storing the report in the memory.

* * * * *